US009683338B2

(12) United States Patent
Tichell Fortea

(10) Patent No.: US 9,683,338 B2
(45) Date of Patent: Jun. 20, 2017

(54) FORM TRAVELLER FOR THE CONSTRUCTION OF ENGINEERING WORKS

(71) Applicant: RUBRICA INGENIERIA Y ARQUITECTURA, S.L., Castellon de la Plana (Castellon) (ES)

(72) Inventor: Enrique Tichell Fortea, Castellon de la Plana (ES)

(73) Assignee: RUBRICA INGENIERIA Y ARQUITECTURA, S.L., Castellon de la Plana (ES)

( * ) Notice: Subject to any disclaimer, the term of this patent is extended or adjusted under 35 U.S.C. 154(b) by 0 days.

(21) Appl. No.: 14/351,921

(22) PCT Filed: Oct. 23, 2012

(86) PCT No.: PCT/ES2012/070736
§ 371 (c)(1),
(2) Date: Apr. 15, 2014

(87) PCT Pub. No.: WO2013/079747
PCT Pub. Date: Jun. 6, 2013

(65) Prior Publication Data

US 2014/0284141 A1 Sep. 25, 2014

(30) Foreign Application Priority Data

Nov. 30, 2011 (ES) ..... 201131943

(51) Int. Cl.
*E01D 21/10* (2006.01)
*E01D 2/04* (2006.01)
(Continued)

(52) U.S. Cl.
CPC ..... *E01D 21/10* (2013.01); *E01D 4/00* (2013.01); *E04G 11/34* (2013.01); *E01D 2/04* (2013.01)

(58) Field of Classification Search
CPC ..... E01D 21/10; E01D 21/105; E01D 2/04; E04G 11/20; E04G 11/34
(Continued)

(56) References Cited

U.S. PATENT DOCUMENTS

2012/0004659 A1 1/2012 Miller et al.

FOREIGN PATENT DOCUMENTS

CN 202000269 10/2011
DE 1263806 B * 3/1968 ..... E01D 21/105
(Continued)

OTHER PUBLICATIONS

International Search Report issued Feb. 8, 2013 in International (PCT) Application No. PCT/ES2012/070736.

*Primary Examiner* — Michael Safavi
(74) *Attorney, Agent, or Firm* — Brown & Michaels, PC

(57) ABSTRACT

The invention relates to a traveller (1) for the construction of engineering works, comprising two structures, namely: a securing structure (2) for securing to the already built engineering work, and a working structure (3) on which construction of the work advances. The traveller is characterized in that the securing structure (2) comprises: a first end ring (6) and a second middle ring (7), both of said rings (6, 7) being coupled to the periphery of the section (27) of the already built work; at least one transom bar (9) that joins the end ring (6) and the middle ring (7) on the side of the carriage (1); and connecting elements between the end ring (6) and the middle ring (7). The working structure (3) comprises exterior formwork (25) and floor formwork (23).

29 Claims, 13 Drawing Sheets

(51) Int. Cl.
*E04G 11/34* (2006.01)
*E01D 4/00* (2006.01)

(58) Field of Classification Search
USPC ..... 425/63, 65; 14/77.1; 264/32, 33; 249/20
See application file for complete search history.

(56) References Cited

FOREIGN PATENT DOCUMENTS

| | | | | | |
|---|---|---|---|---|---|
| DE | 28 48 536 | | | 5/1980 | |
| ES | 2398177 | | * | 3/2013 | ..... E01D 21/10 |
| FR | 546289 | A | * | 11/1922 | ..... E01D 21/00 |
| FR | 1522923 | A | * | 4/1968 | ..... E01D 21/105 |
| FR | 1570648 | A | * | 6/1969 | ..... E01D 21/105 |
| NO | 153502 | B | | 12/1983 | |
| WO | 2009/043749 | | | 4/2009 | |
| WO | WO 2013/149771 | | * | 10/2013 | ..... E01D 21/10 |

* cited by examiner

FORM TRAVELLER FOR THE CONSTRUCTION OF ENGINEERING WORKS

OBJECT OF THE INVENTION

The present invention relates to a traveller for the construction of engineering works, more specifically, equipment for the construction of concrete arches in a progressive manner, without there being other elements required for the construction of the section of concrete than the equipment object of the invention. The invention is applicable to the field of civil works, and more specifically, to the construction of the arch in arch type bridges.

Technical Problem to be Solved

Several construction procedures can be adopted for the construction of bridges of the arch bridge typology.

Among them, the following should be highlighted:

Construction on falsework: this procedure is only valid if the terrain is accessible.

Construction of the arch and deck in a simultaneous manner, introducing a temporary cross-bracing and advancing in cantilever.

Construction with a temporary cross-bracing of the arch and subsequent execution of the deck.

In any construction of arches, formworks are used which, according to the construction procedure selected for the execution of the arch, will have different configurations. Based on whether the formwork is supported on the terrain (construction on falsework) or not (cross-bracing), the resistance requirements in the elements constituting the formwork are very different. In addition, the configuration of the elements transmitting the weight of the formwork itself and of the freshly poured concrete, on to the terrain or to the structure itself (depending on the place where the formwork is supported on) is completely different.

Currently, there are numerous formwork solutions on the market for the construction of arches consisting of one piece supported by the already concreted arch section, which progressively advances in the execution of the arch.

In these structures, the section of the arch to be concreted is usually supported by the last section of the arch that has already been concreted, repeating the same section from the beginning of the arch in the area that is closest to the abutments of the bridge until the completion thereof in the central area of the arch, the modification of the section of the arch being a complicated process.

The equipment object of this invention shows an equipment for the execution of arches in arch type bridge structures. Said equipment is of the typology of those supported by the last arch section concreted, contributing with the possibility of only embracing half concreted arch section and with the possibility of varying the arch section to be built, by modifying the configuration of the exterior and interior formwork.

In the state of the art, document CN 201567787 is known, which discloses a formwork for bridges where the dimensions of the section being built can also be modified.

Document CN 201172797 (Y) is also known, which proposes a mobile formwork for the construction of bridges comprising an interior formwork and exterior formwork, connected to each other.

None of the documents mentioned herein disclose equipment for the construction of bridges supported by an already built bridge section, and that can modify the dimensions of the bridge section to be built.

DESCRIPTION OF THE INVENTION

Traveller for the construction of engineering works, comprising a securing structure for securing to the already built engineering work and a working structure on which construction of the work advances.

The securing structure of the traveller comprises a first end ring coupled to the perimeter of the section of the already built work, a second middle ring coupled to the perimeter of the section of the already built work, at least one transversal cross-brace that joins the end ring and the middle ring on the side of the traveller, connecting elements between the end ring and the middle ring.

The working structure comprises exterior formwork and floor formwork, in which the securing structure and the working structure are joined at the lower part thereof by a main load-bearing girder and at the upper part thereof by the forward tracks.

In a first embodiment of the invention of the traveller for the construction of engineering works, the rings are joined at the upper part thereof by an upper cross-brace framework and at the lower part thereof by at least one main load-bearing girder and a bar framework.

In the first embodiment of the invention, the upper cross-brace framework of the traveller comprises two vertical posts in the upper cross-braces corresponding to the end ring and two other vertical posts in the upper cross-braces corresponding to the middle ring.

A rear skid supported on the forward track is located in the lower part of the vertical posts corresponding to the end ring.

A sliding bar in which lower end a supporting leg is incorporated passes through the inside of each one of the vertical posts corresponding to the middle ring.

The supporting legs comprise a rear skid for supporting the sliding bar on the forward track, the supporting leg being joined to a pair of vertical hydraulic cylinders that lift the supporting legs and the rear skids from the forward tracks, and to a forward hydraulic cylinder responsible for the forward movement of the traveller on the forward tracks.

In the first embodiment of the invention, the rings of the traveller comprise the common elements of the upper cross-brace framework in the upper part, a bar framework in the lower part, two vertical beams joined to each other through horizontal beams and transversal beams, the horizontal beams and transversal beams being distributed along the length of the vertical beams on each side.

In the first embodiment of the invention, the traveller object of the invention comprises a floor formwork in the working structure supported by sill plates perpendicular to the forward direction of the traveller, the main load-bearing girder being located under said sill plates.

In the first embodiment of the invention, the exterior formwork of the traveller comprises exterior panels affixed to vertical ribs, the vertical ribs being supported by their lower part on guides on which the vertical ribs can be displaced, thereby modifying the dimensions of a section to be concreted with respect to another already concreted section.

In addition to being supported on the guides, the vertical ribs are joined to shoring hydraulic cylinders, which in turn are affixed to the exterior end of the aforementioned guides.

In the first embodiment of the invention, the exterior formwork of the traveller incorporates working surfaces located at different heights of the exterior formwork.

In the first embodiment of the invention, the working structure of the traveller comprises an inverted U-shaped interior formwork.

In a second embodiment of the invention, the end ring and the middle ring comprise the common elements: an external beam on a side of the ring corresponding to an external side with respect to the arch, two L-shaped beams, joined to each other by means of threaded bars on a side of the ring corresponding to an internal side with respect to the arch, an upper beam in the upper part of the ring, a lower beam in the lower part of the ring, and coupling means embracing the external beam and joined to the upper beam.

In the second embodiment of the invention, the two L-shaped beams are joined to each other by means of threaded bars, flat pieces being placed in the exterior of the L-shaped beams and nuts threading on the threaded bars and abutting against the flat pieces.

In the second embodiment of the invention, in the upper part of the external beam of the at least the end ring, two vertical hydraulic cylinders are placed, affixed to the external beam by one end, and which are affixed, by the other end, to the coupling means, modifying the distance between the upper beam and the lower beam with the path of the vertical hydraulic cylinders.

In the second embodiment of the invention, the external beam of the rings incorporates, in the upper end, a graduation that allows modifying the affixing point of the vertical hydraulic cylinders to said external beam.

The coupling means in the end ring of the securing structure comprise at least a metal tubular piece through the inside of which the external beam passes, a reinforcement of the tubular piece and a square guide for the coupling means, such that the tubular piece is moves along the external beam supported by the reinforcement guided through the inside of the square guide.

The coupling means in the middle ring of the securing structure comprise at least a metal tubular piece through the inside of which the external beam passes.

In the second embodiment of the invention, the connection between the end ring and the middle ring is obtained in the upper area through the internal part with respect to the arch by means of a longitudinal beam joining the L-shaped beams, and in the external part with respect to the arch by means of two flat beams affixed to the coupling means of the rings; and in the lower part two main load-bearing girders, placed in a parallel manner, that join the lower beams, on the side corresponding to the external part with respect to the arch it is carried out through a transversal cross-brace and two horizontal cross-braces.

In the second embodiment of the invention, the coupling means join the external beam and the upper beam inside of each ring, and the two external beams in the connection between the end ring and the middle ring.

In the second embodiment of the invention, the forward tracks comprise an interior step, wherein forward hydraulic cylinders are supported, coupled, by one end, to the lower part of the upper beam, and by the other end, to the step of the forward tracks.

In the second embodiment of the invention, the upper beam comprises, affixed to its lower part, rolling legs that move along the forward tracks guiding the forward movement of the traveller in their displacement.

In the second embodiment of the invention, the traveller comprises, under the forward tracks, in the area located on the securing structure, crossbeams located between the forward tracks and, in the area located on the working structure, a wedge-shaped platform, the crossbeams and the wedge-shaped platform affixing the relative position of the forward tracks.

In the second embodiment of the invention, the securing structure has ties to the work site that comprise threaded bars, holes made on the upper part of the already concreted section, wedge-shaped pieces affixed to the lower part of the forward tracks, such that the traveller is affixed to an already concreted arch section, introducing the threaded bars through the holes of the already concreted section and through the inside of the wedge-shaped pieces, the ends of the threaded bars being affixed both to the holes and to the wedge-shaped pieces by means of nuts.

In the second embodiment of the invention, the working structure comprises: an interior formwork providing the interior shape of the section; on the side corresponding to the external part with respect to the arch, panels held by shoring props supported by horizontal guides, on the lower area of the traveller, a floor formwork supported by the horizontal guides, which in turn are supported on the main load-bearing girders which also join the two rings of the securing structure; on the upper area of the traveller, a wedge-shaped platform affixed to the forward tracks; on the side corresponding to the internal part with respect to the arch, vertical beams coupled by the upper part of the vertical beams to the wedge-shaped platform and by the lower part of the vertical beams to the horizontal guides, the sides and the lower area configuring the exterior formwork of the working structure.

In the second embodiment of the invention, the interior formwork is affixed to the wedge-shaped platform located under the forward tracks in the area of the working structure, the affixing being carried out by means of threaded bars associated with nuts that abut against the wedge-shaped platform.

In the second embodiment of the invention, the dimensions of the section to be concreted configuring the working structure can be modified by means of at least one of the following actions: removal by unit of the panels of the side corresponding to the external part with respect to the arch, displacement of the shoring props through the horizontal guides, removal by unit of the panels of the side corresponding to the internal part with respect to the arch, and/or complete removal of the vertical beams and panels configuring the side corresponding to the internal part with respect to the arch, this last action being executed to carry out the complete section of the arch by means of the undertaking of half sections joined at the corresponding side to the internal part with respect to the arch.

In the third embodiment of the invention, the securing structure comprises one single securing piece that comprises the first end ring, the second middle ring, the transversal cross-brace and the connecting elements of the first end ring and the second middle ring.

DESCRIPTION OF THE FIGURES

In order to complete the description and with the purpose of facilitating a better comprehension of the characteristics of the device, a set of figures is attached to this specification representing the following in an illustrative rather than limitative manner.

A list of the different elements represented in the figures forming the invention is provided below:

1. —traveller;
2. —securing structure;
3. —working structure;
4. —parallel beams;
6. —end ring;
7. —middle ring;
8. —upper cross-braces;
9 and 9'. —transversal cross-brace;
10 and 10'. —main load-bearing girders;
12. —vertical post;
13. —rear skid;
14 and 14'. —vertical hydraulic cylinder;
15 and 15'. —forward hydraulic cylinder;
16. —sliding bar;
17. —supporting legs;
18 and 18'. —forward tracks;
19. —horizontal beams;
20. —middle cross-braces;
21. —intermediate cross-braces;
22. —displacement means;
23 and 23'. —floor formwork;
24. —sill plates;
25. —exterior formwork;
26 and 26'. —guides;
27. —section;
28. —shoring hydraulic cylinders;
29. —working surface;
30. —vertical cross-brace;
31. —exterior panel;
32. —access hole to the working platforms;
33 and 33'. —vertical beam;
34. —transversal beam;
35 and 35'. —interior formwork;
36. —ties to work;
37; 37'; 37"; 37'''. —threaded bar;
38. —through-hole;
39; 39'; 39"; 39'''. —nut;
40. —panels;
41. —horizontal cross-brace;
42. —internal part;
43. —flat beams;
44. —springers;
45. —central area;
46. —external part;
47. —beam;
  47*e*. —external beam;
  47*l*. —L-shaped beam;
  47*s*. —upper beam;
  47*i*. —lower beam;
48. —graduation;
49. —flat piece;
50. —coupling means;
51. —rolling legs;
52. —wedges;
53. —tubular piece;
54. —longitudinal beam;
55. —shoring prop;
56. —wedge-shaped platform;
57. —reinforcement;
58. —square guide;
59. —crossbeams;
60. —vertical threaded bar;
61. —upper beam;
62. —lateral beam;
63. —through-hole;
64. —lower pushing beams;
65. —supporting legs;
66. —lifting hydraulic cylinder;
67. —hollow end;
68. —securing piece.

DETAILED DESCRIPTION OF THE INVENTION

As provided above, and as shown in the figures, the traveller (1) for the construction of arches in bridges is basically configured by two differentiated structures constituting a single equipment, given that the two structures are joined to each other: a first structure constituting the securing structure (2) for securing to the already built engineering work, and a second structure constituting the working structure (3), where all elements required for the advance of the construction of the arch of the bridge are located, such as structural steel, concrete, working surfaces and formworks.

There are two different embodiments of the traveller (1) for the construction of arches, a first embodiment where the securing structure (2) embraces the entirety of the section of the already built arch, and a second embodiment where the securing structure (2) embraces at least half of the section of the already built arch.

Figure 1:
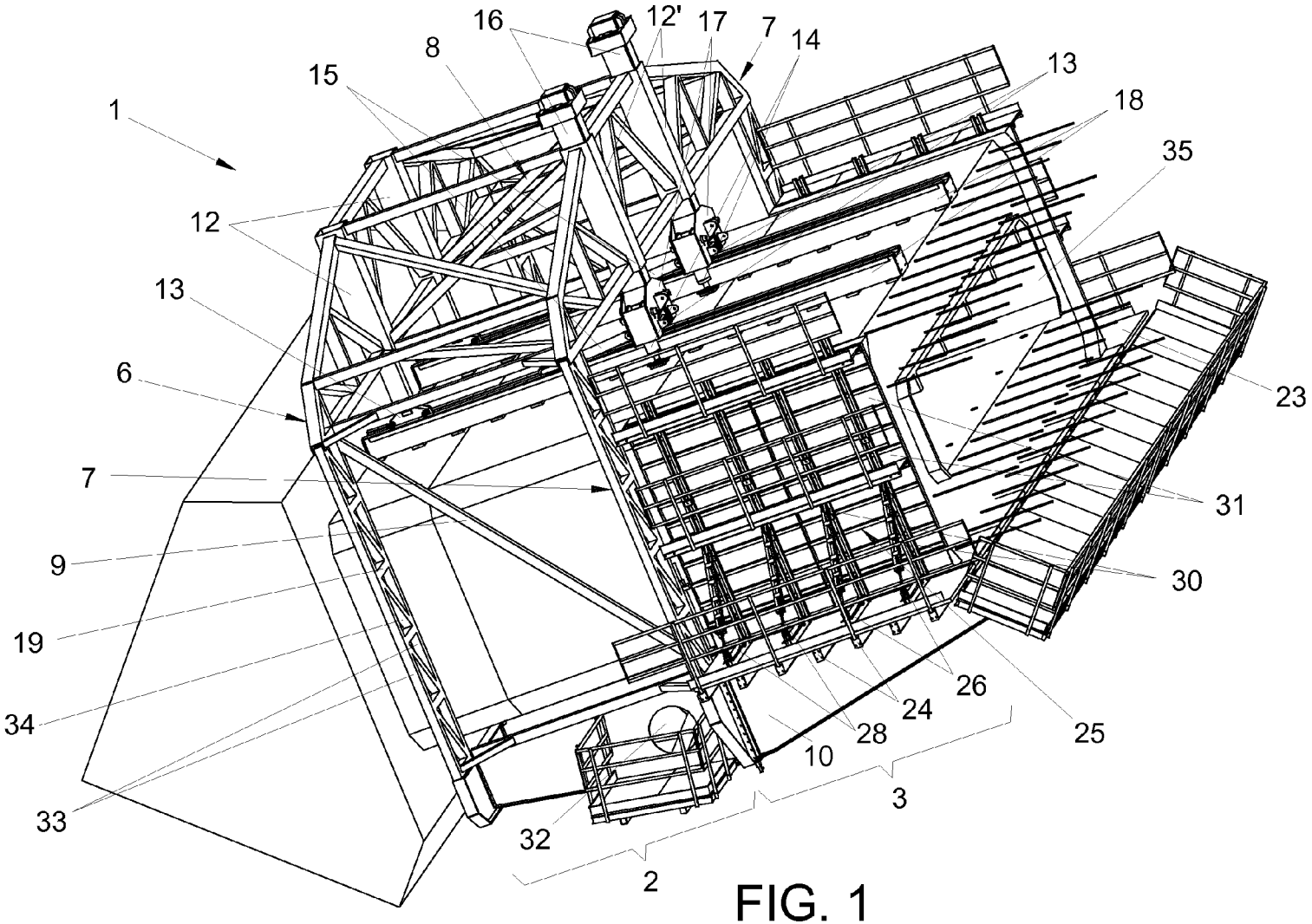
FIG. 1 is a perspective view of the invention according to embodiment 1.

FIG. 1 shows a first embodiment of the traveller (1) for the construction of arches. In this embodiment, the securing structure (2) for securing to the already built engineering work is mainly configured by two rings. The end ring (6) and the middle ring (7) are joined, on their upper part, by an upper cross-brace framework (8), laterally, they are joined by a transversal cross-brace (9), and on their lower part, both rings (6, 7) are joined by a main load-bearing girder (10) in the lateral ends of the rings (6, 7) and by a bar framework on the space between the main load-bearing girders (10).

The transversal cross-brace (9) joining both rings (6, 7) on the side of the traveller (1) transmits the forces generated at the lower part of the middle ring (7) due to the weight of the inclined traveller (1) itself.

The configuration of the end ring (6) and of the middle ring (7) is quite similar. In the upper area of each ring, a part of the upper cross-brace framework (8) forms part of the ring; the two sides of each ring are configured by two vertical beams (33), joined to each other by means of horizontal beams (19) and transversal beams (34) distributed along the length of the vertical beams (33); in the lower area of each ring, we find a bar framework joining the sides of each ring in addition to joining the main load-bearing girders (10) as provided above.

In order to access the space between the main load-bearing girders (10), one of them contains a hole (32) through which the lower area of the securing structure (2) is accessible. A working surface (29) is placed in the exterior of the main load-bearing girder (10), protecting the access through the hole (32) to the space between the main load-bearing girders (10).

Once a complete arch section (27) has been concreted, two forward tracks (18) are placed on the upper area of the arch section (27). In order for the traveller (1) to move forward, said beams are displaced along the already concreted arch section (27) and the traveller (1) is then displaced along the forward tracks (18), positioning said traveller (1) for a new placement, allowing the advance in the construction of the arch by means of successive forward movements.

The securing of the traveller (1) in each new placement is carried out by means of ties to work (36). The ties to work (36) consist of vertical threaded bars (37) introduced into through-holes (38) located in the lower area of the interior formwork (35), made during the concreting. The threaded bar (37) is in turn affixed to the lower area of the securing structure (2). In the upper part of said threaded bars (37), a nut (39) preventing the vertical displacement of the threaded bar (37), and therefore, of the securing structure, is placed. The horizontal displacement of said threaded bar (37), and therefore, of the traveller (1), since it is introduced into the through-hole (38), is not possible.

The upper cross-brace framework (8) joining both rings (6, 7) has two vertical posts (12) for each ring. A fixed rear skid (13) is placed in the lower part of each vertical post (12) of the upper cross-braces (8), in the two vertical posts (12) corresponding to the end ring (6), which is used for the forward movement of the traveller (1). Each rear skid (13) is supported on a forward track (18) on which the rear skid (13) will move during each change of position of the traveller (1).

In the case of the vertical posts (12) of the upper cross-brace framework (8) corresponding to the middle ring (7), a sliding bar (16) passes through the inside of each one of the vertical posts (12), which is displaced downwards in the vertical direction so the traveller (1) is supported by the same during its forward movement, and is lifted vertically when the traveller (1) is in a static position.

The supporting legs (17) are located in the lower part of the vertical sliding bars (16), which incorporate a rear skid (13) for supporting the vertical sliding bar (16) on one of the forward tracks (18). The supporting leg (17) is joined to a hydraulic system, which, in a preferred embodiment of the invention, consists of three hydraulic cylinders, of which a pair of vertical hydraulic cylinders (14), one on each side of the forward track (18), is in charge of executing the vertical movement of the sliding bar (16), and a forward hydraulic cylinder (15) is responsible for the forward movement of the traveller (1) and of the forward tracks (18).

The upper cross-brace framework (8) is constituted by a series of bars providing rigidity to the traveller (1) by joining the two rings (6, 7) to each other on the upper part of the traveller (1).

The working structure (3), located to the right in FIG. 1, is configured with a lower part having a floor formwork (23) supported on sill plates (24) perpendicular to the forward direction of the traveller (1), under which there is another main load-bearing girder (10) placed next to the main load-bearing girder (10) of the securing structure (2). On the sides of the floor formwork (23), we find the exterior formwork (25) supported on guides (26) that allow the displacement thereon of the exterior formwork (25), thereby varying the exterior dimensions of the section (27) of the arch to be executed.

The exterior formwork (25) is formed by exterior panels (31) that are vertically arranged one on top of the other affixed to a vertical rib (30), said vertical rib (30) being joined by its lower part to horizontal guides (26) that allow the displacement of the vertical ribs (30), thereby modifying the exterior geometry of the section (27) of the arch.

In order to carry out the stripping of the section (27) of the arch, the vertical ribs (30) sustaining the exterior panels (31) of the exterior formwork (27) are joined to shoring hydraulic cylinders (28), which in turn are affixed to the exterior end of the horizontal guides (26), such that, by means of the contraction of the shoring hydraulic cylinders (28), the separation of the exterior formwork (27) takes place. Said separation takes place with the rotation of the vertical ribs (30) of the exterior formwork (25) around the connecting point of said vertical ribs (30) and the horizontal guides (26).

The exterior formwork (25) incorporates horizontal working surfaces (29) on its exterior part placed at different heights of the aforementioned exterior formwork (25), the highest working surface (29) being at the highest level of the section (27) of the arch.

Figure 2:
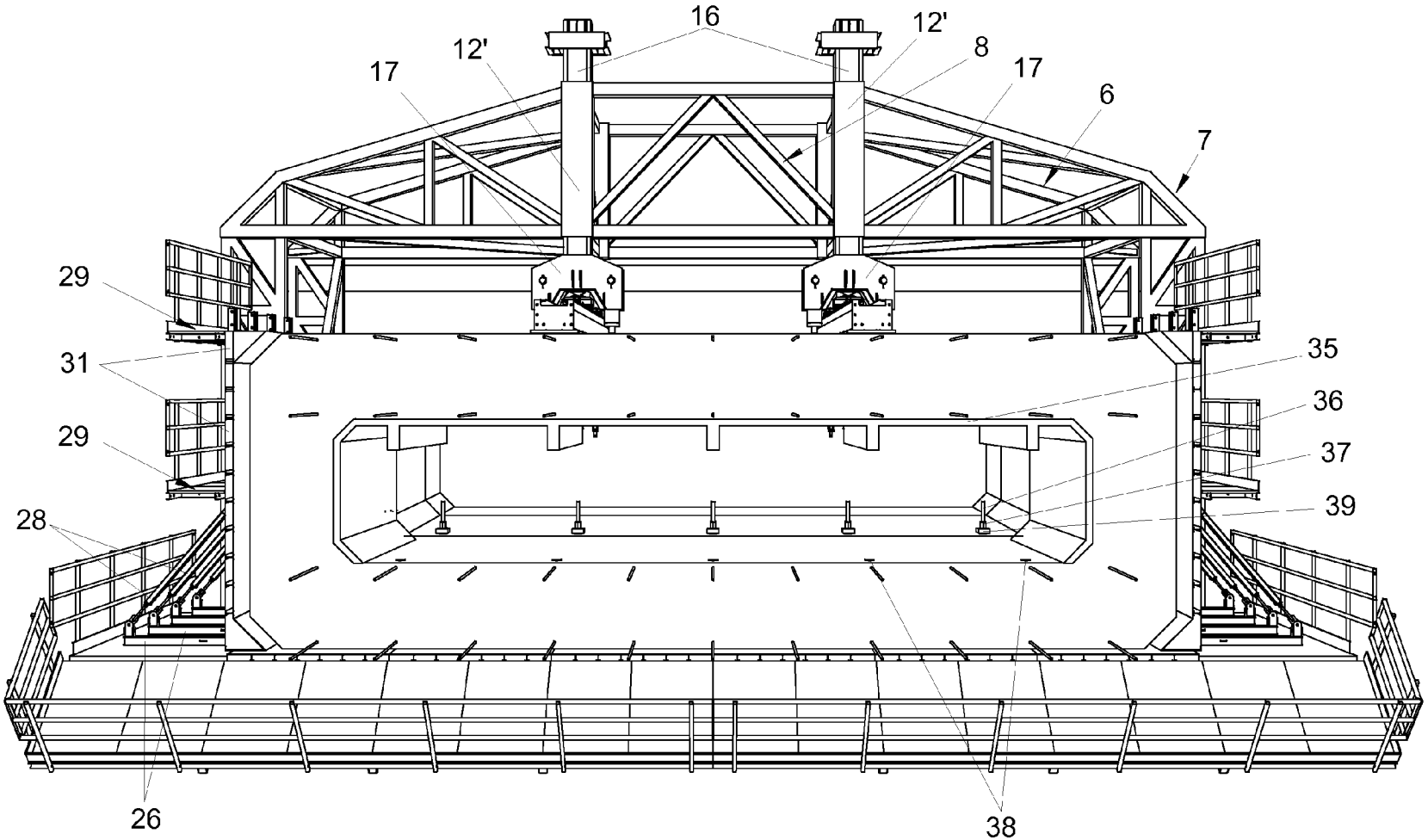
FIG. 2 is a frontal view of the invention according to the embodiment of FIG. 1.
Figure 3:
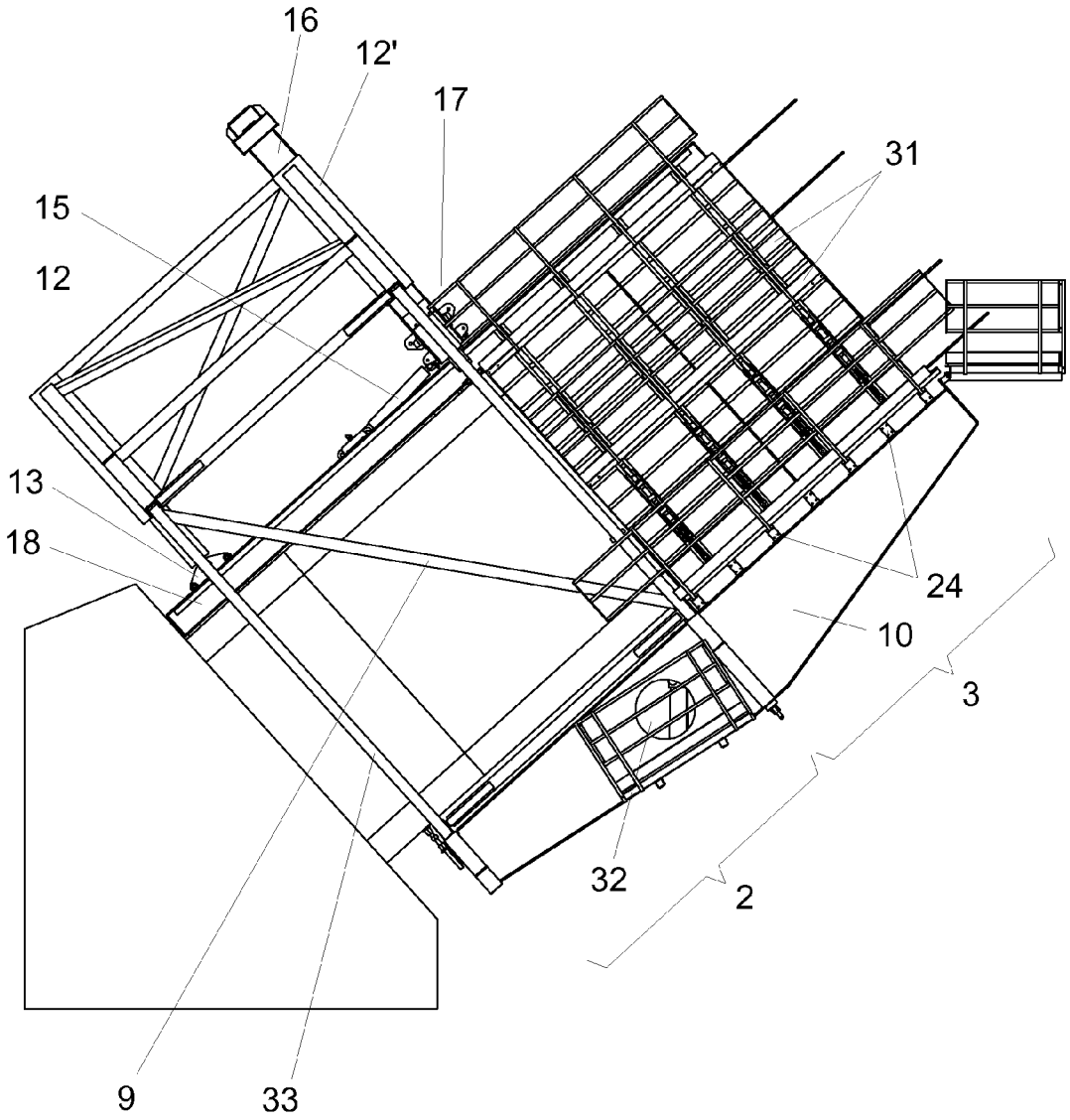
FIG. 3 is a lateral view of the invention according to the embodiment of FIG. 1.
Figure 4:
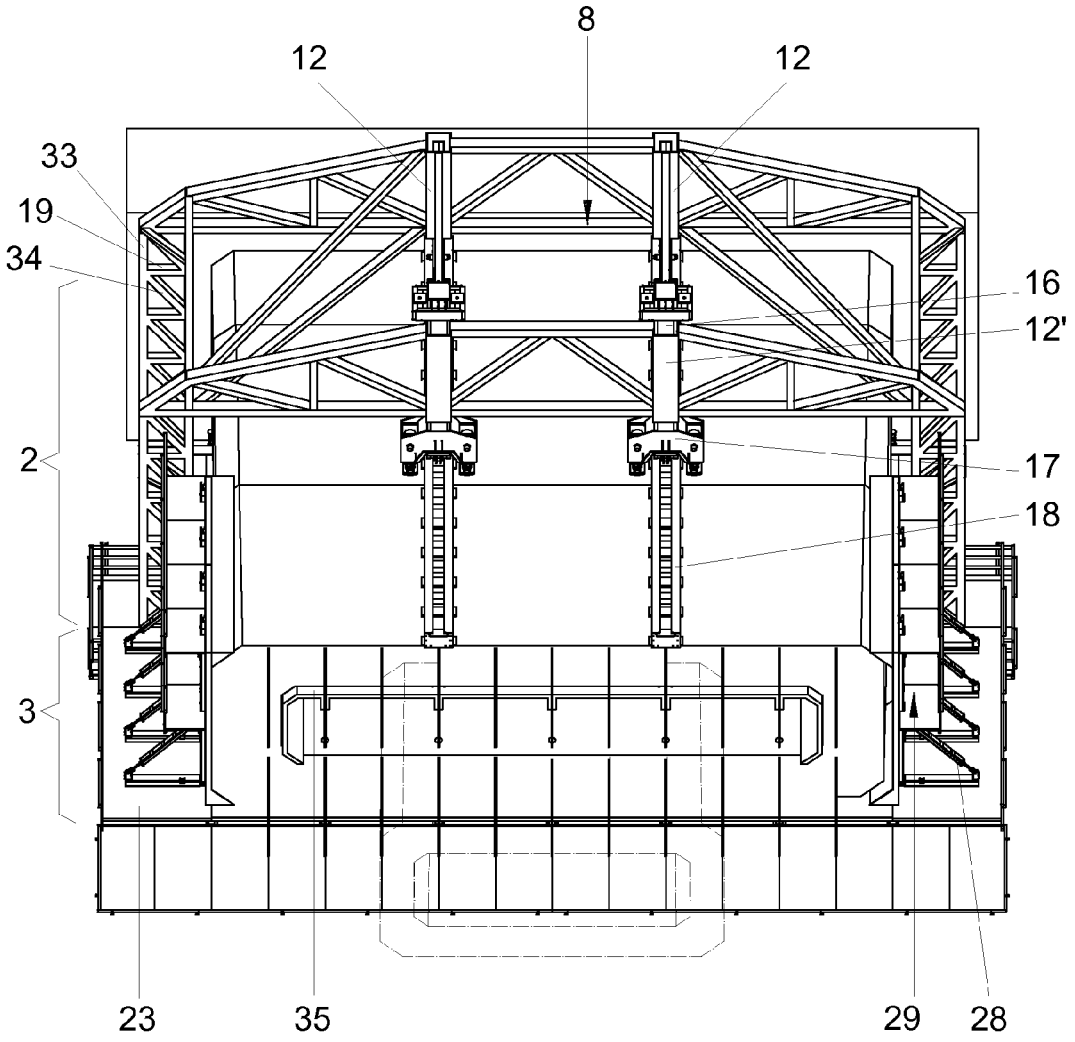
FIG. 4 is a plant view of the invention according to the embodiment of FIG. 1.

The interior formwork (35) (shown in FIG. 2) has an inverted U shape and is located inside the section (27) to be concreted, providing the final hollow configuration of the section (27) of the arches of bridge (5) arches. Said interior formwork (35) can have the dimensions required for the arch section (27) being built.

Two structures are differentiated in this first embodiment of the traveller (1), a carrying structure for the forward phase of the traveller, which comprises the two rings (6, 7), the upper cross-brace framework (8) and the transversal cross-brace (9), and a carrying structure for the concreting phase, which comprises the main load-bearing girders (10) and all elements of the exterior formwork (25).

The variability in the dimensions of the interior formwork (35), together with the possibility of varying the position of the exterior formwork (25) by means of the displacement of said exterior formwork (25) through the guides (26), makes the traveller (1) object of the invention adaptable to multiple arch dimensions.

Figure 5:
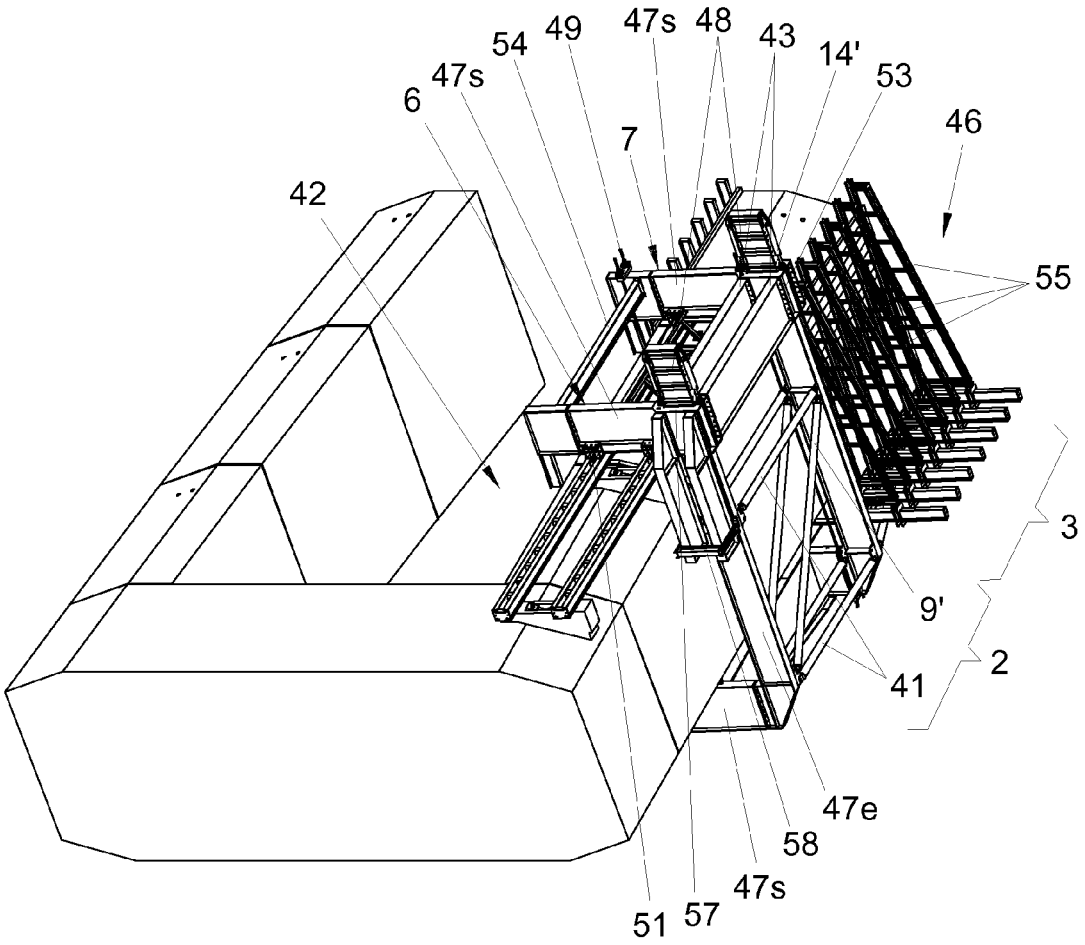
FIG. 5 is a perspective view of the invention according to embodiment 2.

The second embodiment of this traveller (1) for the construction of arches for bridges (5) is reflected in FIG. 5. This embodiment is designed for the construction of a typology of arch where the section (27) varies from the springers (44) of the arch until the central area thereof (45). In the springers (44) of the arch, the section (27) has the shape of a D, and there are two independent sections in each arch springer (44), while in the central area (45) of the arch, the two D-shaped sections are joined by the flat part of the D, and they become a single section (27).

The modification of the section (27) of the springers (44) of the arch until the section (27) of the central area (45) is obtained by modifying the configuration of the working structure (3). Said modification of the configuration of the working structure (3) is the consequence of the modification of the configuration of the securing structure (2), which will begin to modify its configuration according to the advance of the construction of the arch, following the variation of the section (27) of the arch from the springers (44) until the central area (5) referred to above.

In this second embodiment, the securing structure (2) is also formed by two rings, an end ring (6) and a middle ring (7), through which the affixing of the traveller (1) to an already concreted arch section (27) is carried out.

The end ring (6) and the middle ring (7) have a similar configuration. Each ring is formed by different beams. The sides of the rings (6, 7) are classified into two: the side of the external part (46) with respect to the arch and the side of the internal part (42) with respect to the arch.

The side of the internal part (42) with respect to the arch is configured by two L-shaped beams (47*l*), joined to one another by two threaded bars (37') wherein two flat pieces (49) are located on the exterior of the L-shaped beams (47*l*). Nuts (39') are placed on the aforementioned flat pieces (49), which thread in the threaded bars (37') preventing the movement of the L-shaped beams (47*l*).

The side of the external part (46) with respect to the arch is formed by an external beam (47*e*) in which upper part two vertical hydraulic cylinders (14') are placed.

The lower part of the ring is formed by a lower beam (47*i*), joined by one end to the external beam (47*e*) and by the other end to one of the L-shaped beams (47*l*).

The upper area of each ring is formed by an upper beam (47*s*), and the displacement means (22) of the traveller, which move along the forward tracks (18'), are affixed to the lower part of said upper beam (47*s*).

Likewise, the upper beam (47*s*) is affixed, on the side corresponding to the external beam (47*e*), to coupling means (50) embracing the aforementioned external beam (47*e*) and move along the same. The vertical hydraulic cylinders (14') are joined to the aforementioned coupling means (50).

The coupling means (50) are configured to embrace the external beam (47*e*) as a metal tubular piece (53) through the inside of which the external beam (47*e*) passes, a reinforcement (57) of the tubular piece and a square guide (58). The reinforcement (57) is constituted by two parallel beams (4) affixed to the tubular piece (53), such that the tubular piece (53) is guided in its displacement along the length of the external beam (47*e*), supported by the reinforcement (57) guided through the inside of the square guide (58).

In order to modify the distance between the upper beam (47*s*) and the lower beam (47*i*), in addition than between the vertical hydraulic cylinders (14'), there is a graduation (48) in the upper area of the external beam (47*e*) which, by means of the affixing of the vertical hydraulic cylinders (14') in different predefined positions in the graduation (48) of the external beam (47*e*), allows modifying the position of the vertical hydraulic cylinders (14') of the aforementioned external beam (47*e*).

The displacement means (22) of the traveller consist of rolling legs (51) that pass through forward tracks (18') such that the traveller is guided by the forward tracks (18'). The rolling legs (51) are affixed to the lower part of the upper beam (47*s*). The forward tracks (18') in this second embodiment have an interior step, which will serve to secure the traveller (1) in a position and to be supported thereon for the forward movement of the traveller (1).

The relative parallel position of the two forward tracks (18') is maintained because in the area corresponding to the securing structure (2) between the forward tracks (18'), a series of crossbeams (59) is located, and in the area corresponding to the working structure (3), a wedge-shaped platform (56) is located, which provides the D shape to the section (27) through the lower part of the wedge-shaped platform (56), and through the upper part is affixed to the forward tracks (18'), maintaining the relative position of the aforementioned forward tracks (18').

The forward movement of the traveller (1) is obtained by means of forward hydraulic cylinders (15') coupled to the lower part of the upper beam (47*s*) of the middle ring (7), next to the rolling legs (51) of said middle ring (7). The end opposite to the one coupled to the forward wheels (51) is coupled from the forward hydraulic cylinder (15') to the step of the forward tracks (18'). The forward movement of the traveller (1) guided by the forward tracks (18') takes place supported by said step.

The connection between both rings (6, 7) takes place through different elements according to the area of the rings (6, 7) being connected. On the side corresponding to the external part (46) with respect to the arch, the connection between the two lateral beams (47*e*) is carried out by means of a Z-shaped structure comprising a transversal cross-brace (9'), and two horizontal cross-braces (41). In the lower part, the two rings (6, 7) are joined by two main load-bearing girders (10') placed in parallel and joining the lower beams (47*i*) of the two rings (6,7). In the upper area, the connection between the rings (6, 7) is carried out by the internal part with respect to the arch (42) by means of a longitudinal beam (54) joining the L-shaped beams (47*l*), and in the external part (46) with respect to the arch by means of two flat beams (43) affixed to the coupling means (50).

This way, the upper beam (47*s*) is joined through the coupling means (50) to the external beam (47*e*) within the ring itself, and the two external beams (47*e*) to each other in the connection between the two rings (6, 7).

In order to affix the traveller to the already concreted section (27), the securing structure (2) has ties to the work (36) constituted by threaded bars (37") introduced into holes (32) made on the upper part of the section (27).

In order to embrace the D-shaped section (27), the securing structure (2) has two wedge-shaped pieces (52) affixed to the lower part of the forward tracks (18') by means of the same threaded bars (37") constituting the ties to work (38).

The affixing to the concreted section (27) takes place by means of the threaded bars (37") which, introduced through the holes (32), are affixed by means of nuts (39"), in one end to an interior area of the section (27), and in the other end, to the wedge-shaped pieces (52), which in turn are affixed to the lower part of the forward tracks (18').

Figure 6:
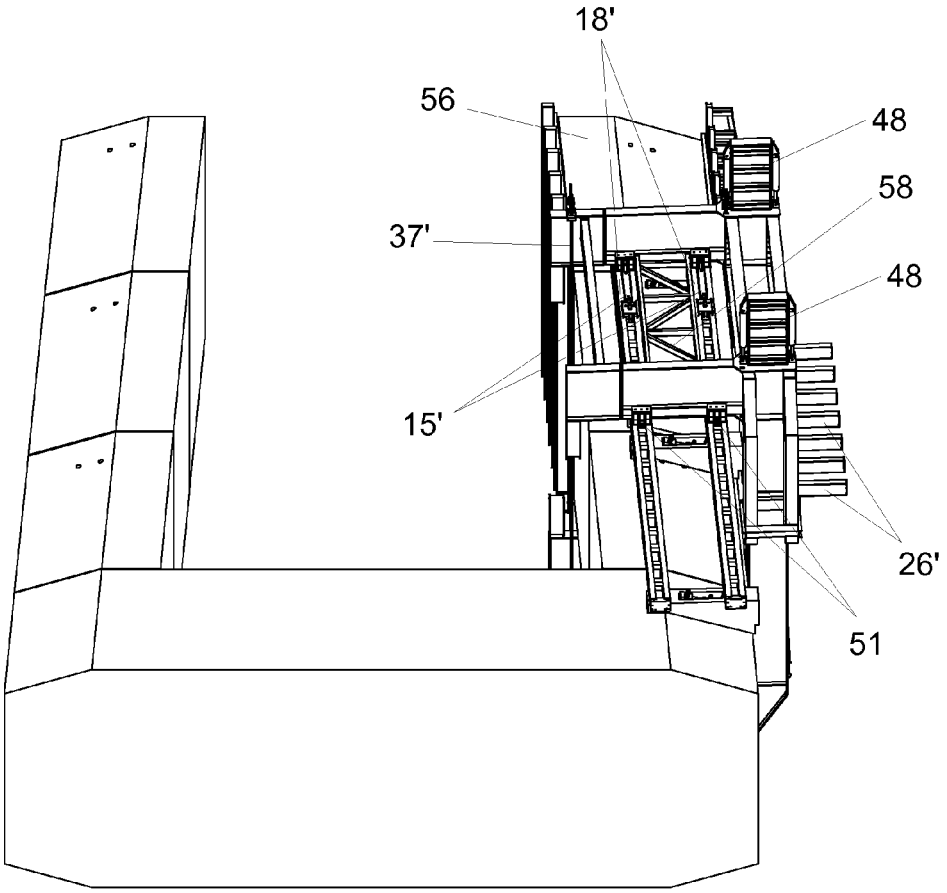
FIG. 6 is a perspective view of the invention according to the embodiment of FIG. 5.
Figure 7:
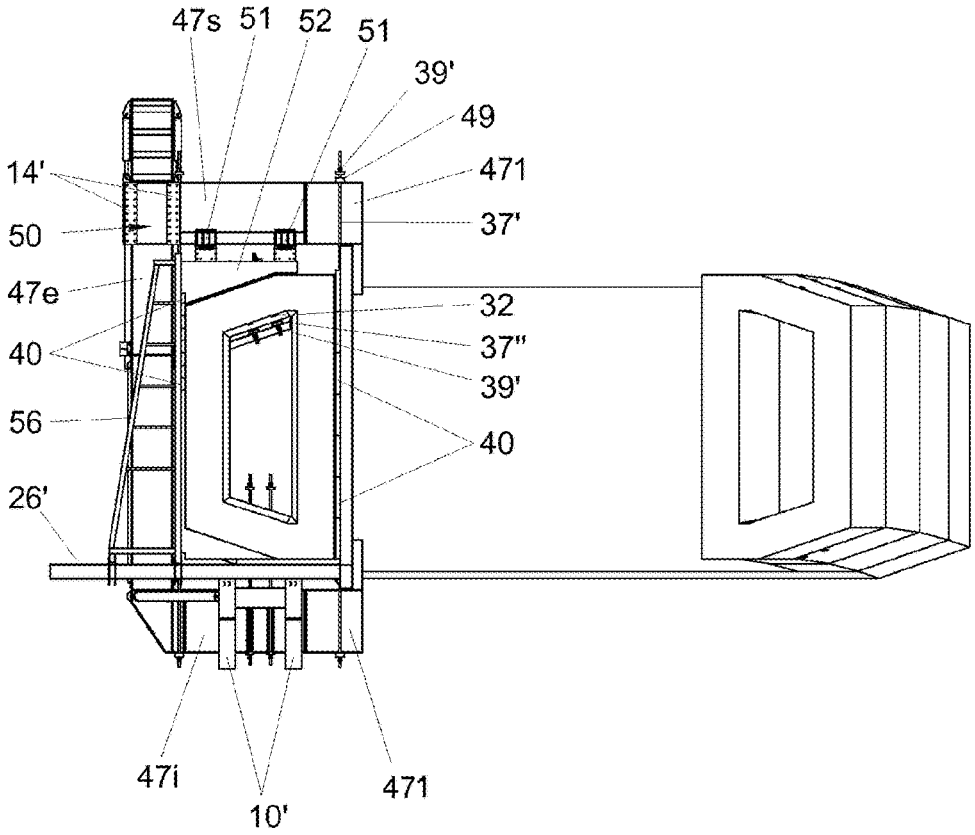
FIG. 7 is a frontal view of the invention according to the embodiment of FIG. 5.
Figure 8:
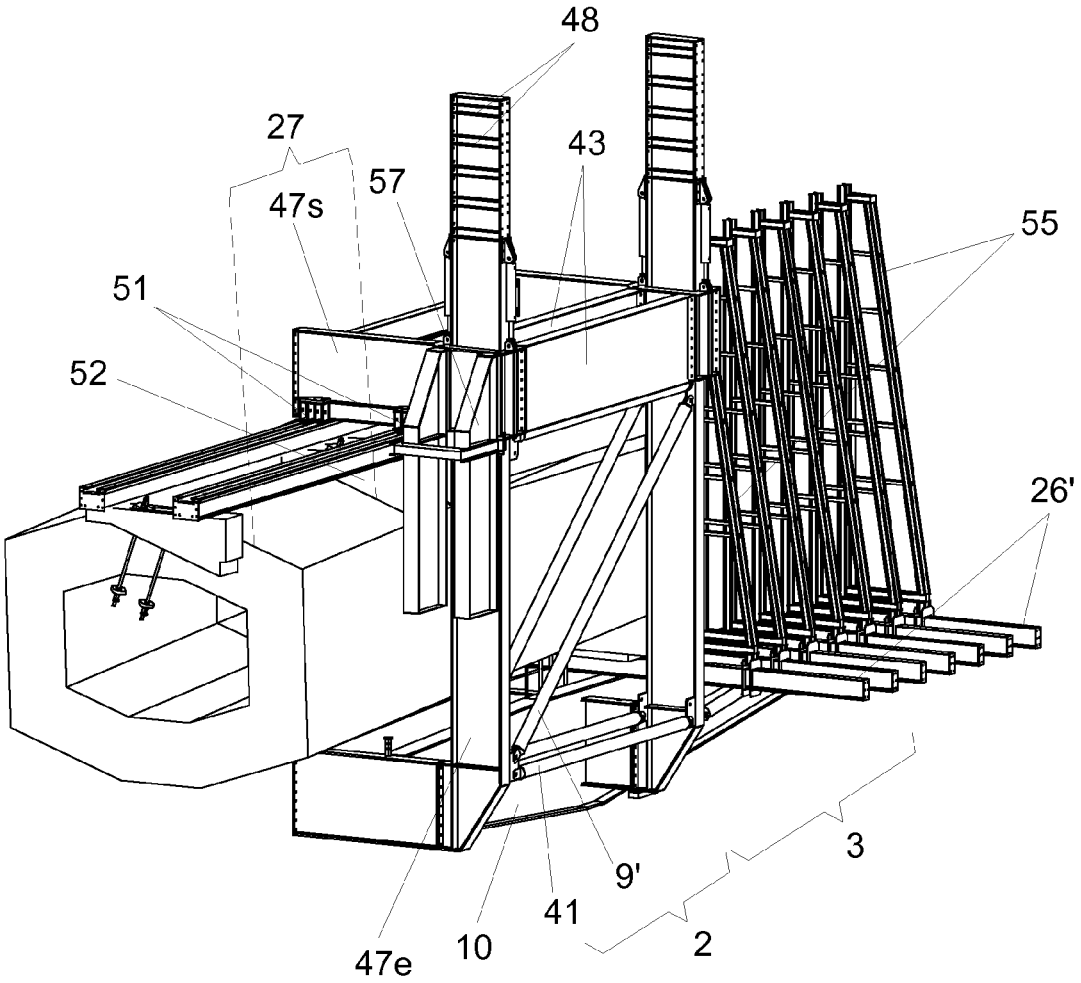
FIG. 8 is a perspective view of the invention according to the embodiment of FIG. 5 when a section of the central area of the arch has already been adapted.
Figure 9:
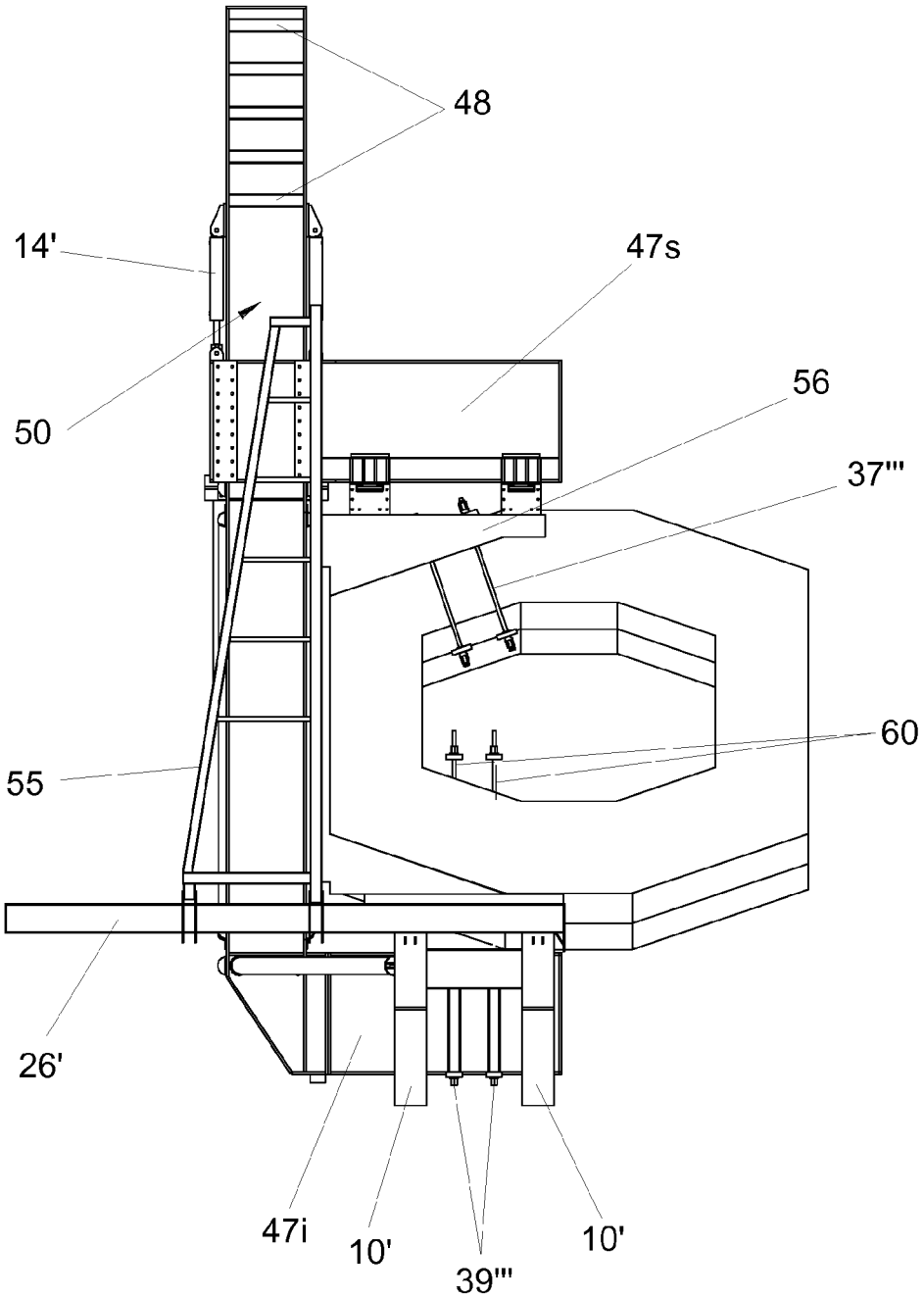
FIG. 9 is a frontal view of the equipment for the construction of arches in the situation of FIG. 8.
Figure 10:
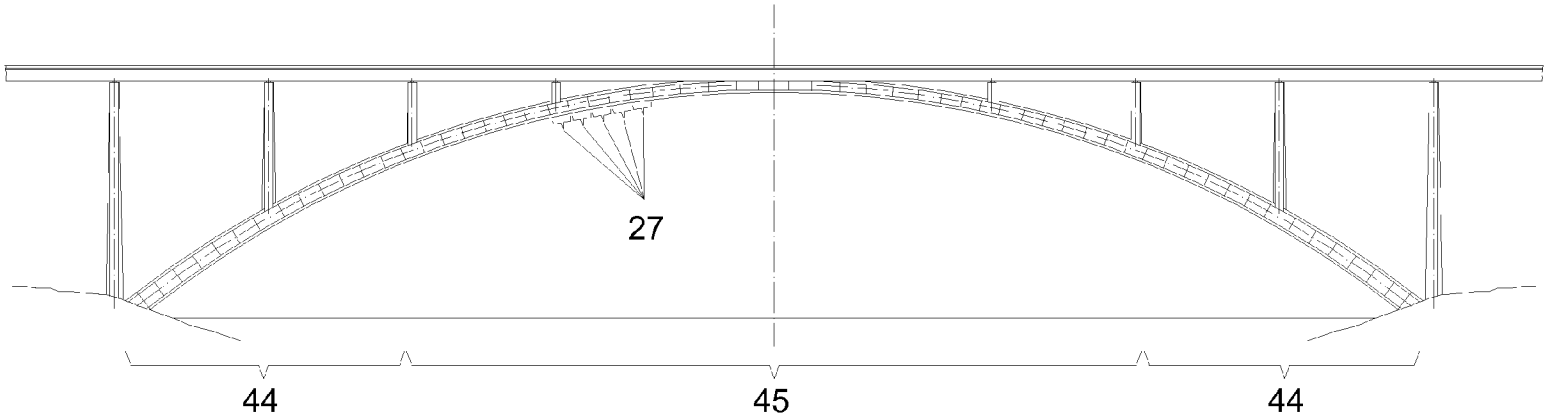
FIG. 10 shows an elevation view of a bridge to be executed with a traveller according to the embodiment of FIG. 5.
Figure 11:
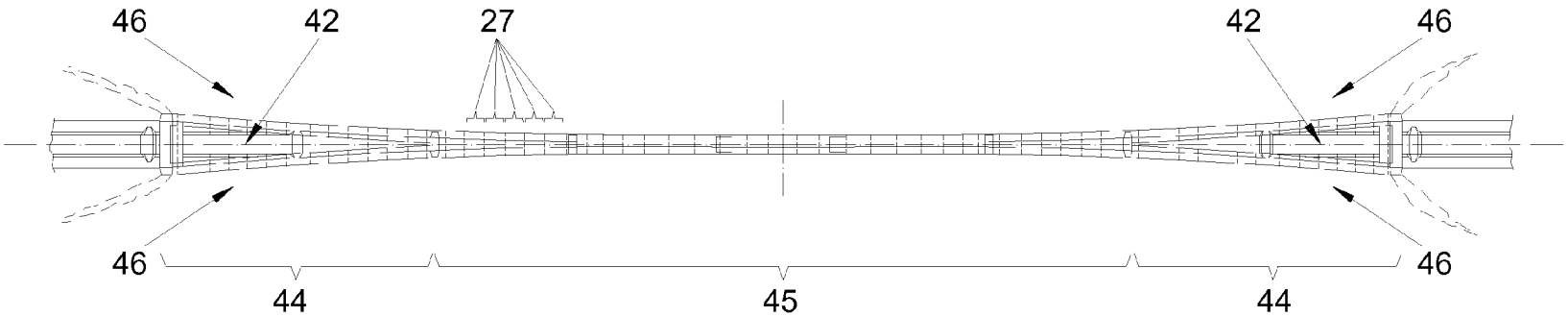
FIG. 11 shows a plant of a bridge to be executed with a traveller according to the embodiment of FIG. 5.

The working structure (3) of this second embodiment (shown in FIGS. 5 and 6) is configured in its interior area by a floor formwork (23') supported on horizontal guides (26'), which in turn are supported by two main load-bearing girders (10'), the ones found in the lower part of the securing structure (2) as well.

The side of the working structure (3) corresponding to the external part (46) with respect to the arch is configured by panels (40) supported by a series of shoring props (55), which in turn is supported by the horizontal guides (26').

The panels (40) can be removed unit by unit modifying the height of the section (27). This modification of the height of the section (27) to be concreted corresponds to the modification of the distance between the upper beam (47*s*) of the rings (6, 7) and the lower beam (47*i*) in the modification of the configuration of the securing structure (2).

The upper area of the working structure (3), the one providing the curved configuration in the upper area of the D-shaped section (27), has the configuration that also contributes to maintaining the relative position of the forward tracks in the working structure, that is to say: a wedge-shaped platform (56) is placed under the forward tracks (18), to which the interior formwork (35') of the section (27) is affixed by means of threaded bars (37").

Through the lower area of the securing structure (2), affixing the relative position of the traveller (1), vertical threaded bars (60) are introduced, which are affixed to the lower beam (47*i*) and to the already concreted section by means of nuts (39'") placed in the ends of the aforementioned vertical threaded bars (60).

The side of the working structure (3) corresponding to the internal part (42) with respect to the arch is composed of vertical beams (33') coupled by the upper part of the vertical beams (33') to the wedge-shaped platform (56) and by the lower part of the vertical beams (33') to the horizontal guides (26'). Panels (40) are placed in the vertical beams (33'), which form the exterior formwork (25) of the section (27). As the section (27) is modified in the construction of the arch, panels (40) are progressively dismounted. This side is fully dismounted when the two sections of the springers (44) of the arch in the central area (45) of the aforementioned arch connect.

Figure 12:
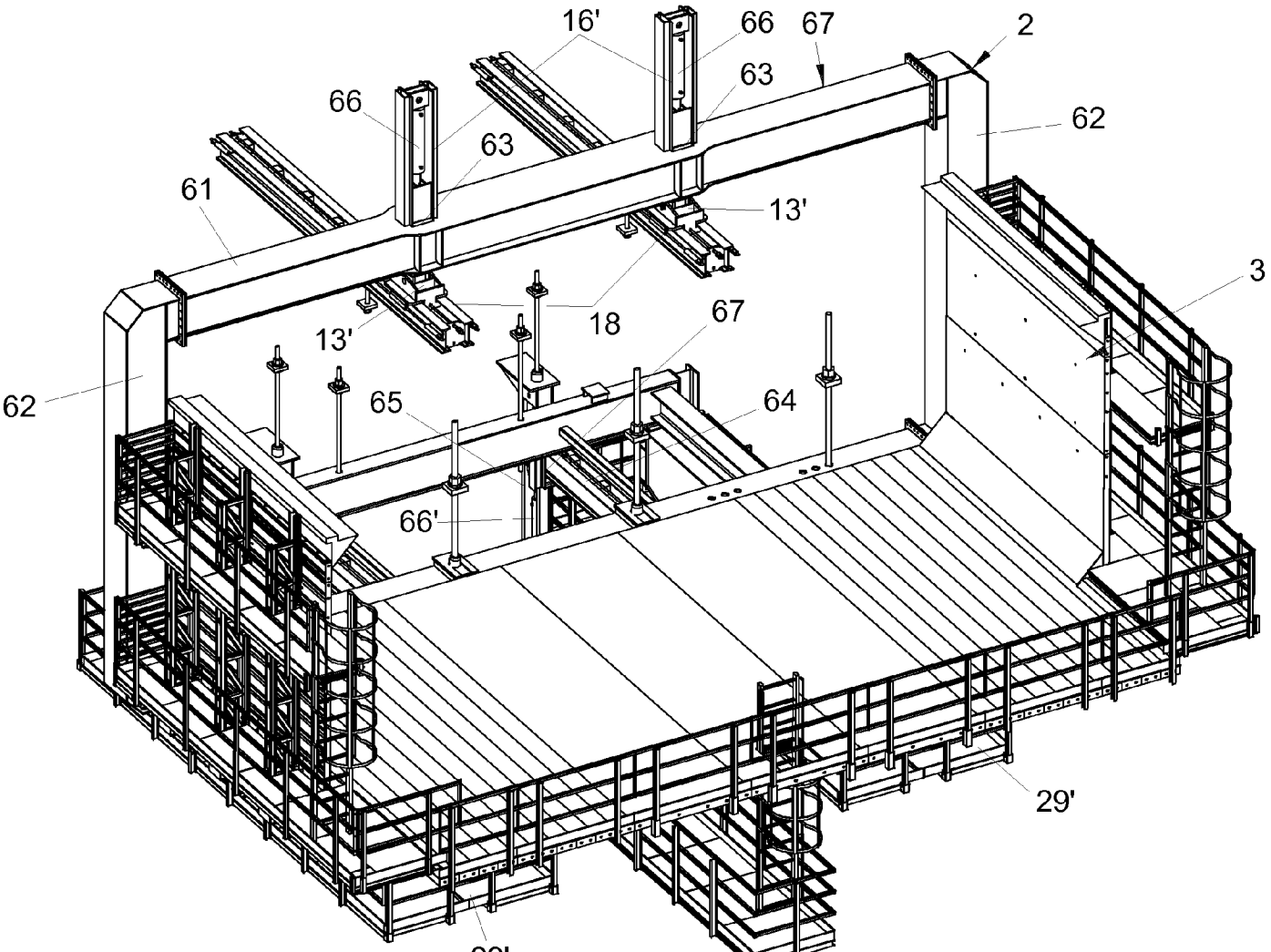
FIG. 12 shows a perspective view of the invention according to the third embodiment.
Figure 13:
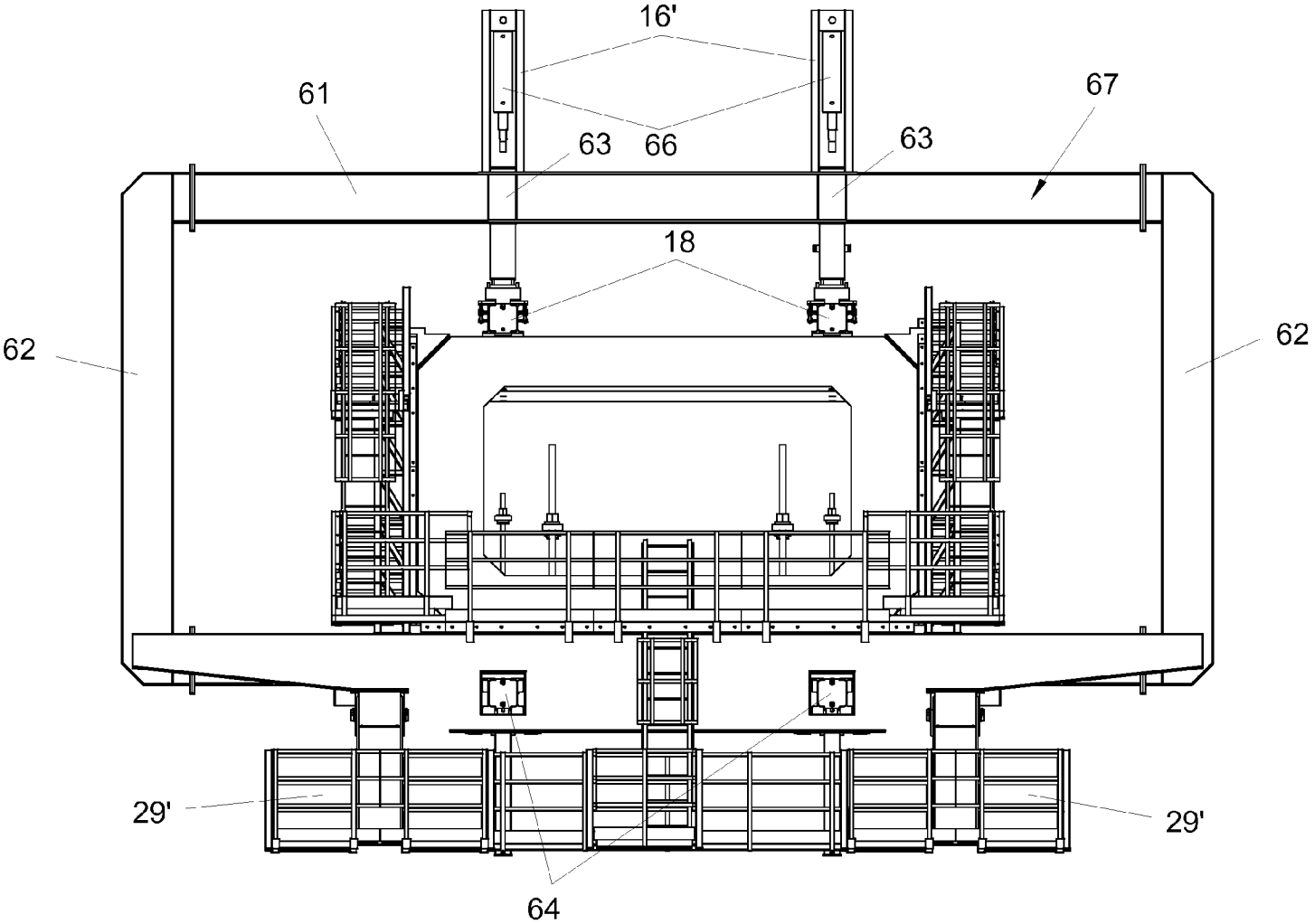
FIG. 13 shows a frontal view of the invention according to the embodiment of FIG. 12.
Figure 14:
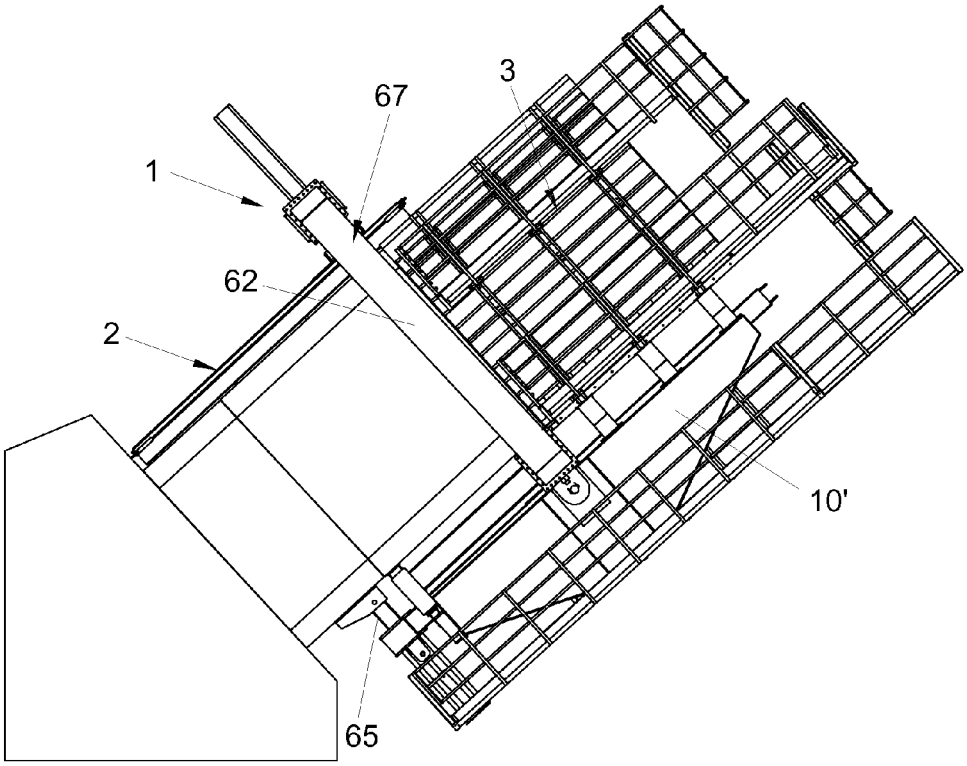
FIG. 14 is a lateral view of the invention according to the embodiment of FIG. 12.

FIG. 12 shows a third embodiment of the traveller (1) for the execution of arches. In this third embodiment, with respect to the first embodiment, the securing structure (2) of the traveller (1) varies and the working structure (3) is similar to the working structure of the first embodiment.

In the third embodiment, the structure (2) for securing to the already built engineering work comprises an end ring (6) and a middle ring (7) forming one single securing piece (67), together with the transversal cross-brace (9) and the connecting elements between both rings.

Said single piece comprises, on its upper part, an upper beam (61), on each side, a lateral beam (62), and on the lower part, two main load-bearing girders (10') likewise joining the securing structure (2) and the working structure (3).

The lower part of the traveller (1) in this third embodiment also comprises a bar framework in addition to the two main load-bearing girders (10).

A working surface (29') is placed exteriorly with respect to the main load-bearing girder (10'), facilitating the access to the main load-bearing girders (10').

Once a complete arch section (27) has been concreted, two forward tracks (18') are placed on the upper area of the arch section (27), which enables the forward movement of the traveller (1). In order for the traveller (1) to move forward, said beams are displaced along the already concreted arch section (27) and the traveller (1) is then displaced along the forward tracks (18'), positioning said traveller (1) for a new placement, allowing the advance in the construction of the arch by means of successive forward movements.

There are two through-holes (63) in the upper beam (61) of the securing structure (2). There is a sliding bar (16') placed in correspondence with each through-hole (63), and in the lower part of each sliding bar (16'), a skid (13') is placed. Each sliding bar (16) incorporates a lifting hydraulic cylinder (66) in its interior, joined by one end to an end of the sliding bar (16') and by the other end to the upper beam (61) of the securing structure (2).

The skid (13') is supported, by means of a forward track (18), by the concreted structure. Each skid (13') moves along the forward track (18) in each change of position of the traveller (1). The sliding bar (16) is joined to the upper beam (61), being displaced vertically inside of the through-hole (63) of said upper beam (61).

There are two lower pushing beams (64) on the lower area of the traveller (1), which are affixed to the lower area of the traveller (1) by means of supporting legs (65).

Each supporting leg (65) is formed by a beam, within which section there are lifting hydraulic cylinders (66') incorporated. Said lifting hydraulic cylinders (66') are affixed to each supporting leg (65) by one end, and by the other end to the traveller (1). These lifting hydraulic cylinders (66'), together with the lifting hydraulic cylinders (66) incorporated by the sliding bar (16), carry out the ascent and descent of the traveller (1) in the forward movement thereof.

The lower pushing beams (64) comprise a hollow end (67) through which the supporting leg (65) passes, the supporting leg (65) being located orthogonally to the lower pushing beam (64).

The forward movement of the traveller (1) of this third embodiment is carried out by following the following steps:

- with the traveller (1) located in the concreting position, the forward tracks (18') move forward;
- the descent of the traveller (1) is obtained with the relative movement of the sliding bar (16') with respect to the upper beam (61), the traveller (1) being supported, by means of the skids (13'), by the concreted structure;
- forward movement of the aforementioned traveller (1), pushed by the lower pushing beams (64) on the forward tracks (18');
- once the traveller (1) moves towards the position of a new placement, the traveller (1) is lifted by the relative movement of the sliding bar (16') with respect to the upper beam (61);
- concreting of a new section (27);
- the process is repeated.

The invention claimed is:

1. A traveler for construction of an engineering work, comprising:

a) a securing structure for securing the traveler to an already-built section of the engineering work, comprising:

an end ring coupled to a perimeter of the already-built section of the engineering work;

a middle ring coupled to the perimeter of the already-built section of the engineering work;

at least one transversal cross-brace joining the end ring and the middle ring on a side of the traveler; and a plurality of connecting elements between the end ring and the middle ring;

b) a working structure on which construction of the engineering work advances, comprising an exterior formwork and a floor formwork;

wherein the securing structure and the working structure are joined at a lower part thereof by a main load-bearing girder and at an upper part thereof by a plurality of forward tracks.

2. The traveler of claim 1, in which the middle ring and end ring of the securing structure are joined at an upper part thereof by an upper cross-brace framework and at a lower part thereof by at least one main load-bearing girder and a bar framework.

3. The traveler of claim 2, in which the upper cross-brace framework comprises two vertical posts coupled to a plurality of upper cross-braces joined to the upper part of the end ring and two vertical posts coupled to a plurality of upper cross-braces joined to the upper part of the middle ring.

4. The traveler of claim 3, further comprising a rear skid supported on a forward track coupled to a lower part of the two vertical posts which are coupled to the plurality of upper cross-braces which are joined to the end ring.

5. The traveler of claim 3, further comprising a plurality of sliding bars with each sliding bar passing through an inside of a respective one of the two vertical posts which are coupled to the plurality of upper cross-braces which are joined to the middle ring.

6. The traveler of claim 5, further comprising a plurality of supporting legs, each supporting leg being coupled to a lower end of one of the plurality of sliding bars.

7. The traveler of claim 6, in which each of the supporting legs comprises:

a rear skid for supporting the sliding bar on the forward track;

a pair of vertical hydraulic cylinders coupled to the supporting leg on opposite sides of the forward track, such that operation of the vertical hydraulic cylinders lifts the supporting legs and the rear skids from the forward tracks, and a forward hydraulic cylinder coupled to the supporting leg and one of the plurality of forward tracks, such that operation of the forward hydraulic cylinder causes forward movement of the traveler on the forward tracks.

8. The traveler of claim 1, in which each of the end ring and the middle ring further comprise:

an upper cross-brace framework in the upper part of each of the end ring and the middle ring;

a bar framework in the lower part of each of the end ring and the middle ring;

two vertical beams;

a plurality of horizontal beams joining the two vertical beams and distributed along a length of each of the two vertical beams on each side of each of the vertical beams; and a plurality of transversal beams joining the two vertical beams and distributed along the length of each of the two vertical beams.

9. The traveler of claim 1, in which the floor formwork of the working structure is supported by a plurality of sill plates perpendicular to the forward tracks, and the main load-bearing girder is located under the plurality of sill plates.

10. The traveler of claim 1, in which the exterior formwork of the working structure comprises a plurality of exterior panels affixed to a plurality of vertical ribs movably supported on guides, such that dimensions of a section of the engineering work to be concreted can be altered with respect to dimensions of an adjacent already-built section of the engineering work.

11. The traveler of claim 10, further comprising a plurality of shoring hydraulic cylinders mounted between the plurality of vertical ribs and the guides.

12. The traveler of claim 10, in which the exterior formwork comprises working surfaces located at different heights on the exterior formwork.

13. The traveler of claim 1, in which the working structure comprises an inverted U-shaped interior formwork.

14. The traveler of claim 1, in which the engineering work is a structure having an arch with an internal side and an external side, and each of the end ring and the middle ring further comprise:

an external beam on a side of each of the end ring and the middle ring corresponding to an external side of the arch;

two L-shaped beams (471), joined by threaded bars on a side of the ring corresponding to an internal side of the arch;

an upper beam in the upper part of each of the end ring and the middle ring;

a lower beam in the lower part of each of the end ring and the middle ring; and a coupler, joining the external beam and the upper beam.

15. The traveler of claim 14, further comprising a plurality of flat pieces fastened to the L-shaped beams by nuts threaded on the threaded bars.

16. The traveler of claim 14, further comprising two vertical hydraulic cylinders, affixed on a first end to an upper part of the external beam of at least the end ring, and affixed on a second end to the coupler, such that a distance between the upper beam and the lower beam can be modified with respect to a path of the vertical hydraulic cylinders.

17. The traveler of claim 16, in which the external beam of each of the end ring and the middle ring comprises a graduation on the upper part of the external beam for affixing the first end of the two vertical hydraulic cylinders to the external beam.

18. The traveler of claim 14, in which the coupler of the end ring of the securing structure comprises:

a metal tubular piece having a reinforcement and an inside through which the external beam passes, guided by a square guide;

such that the tubular piece moves along the external beam supported on the reinforcement, and guided by the square guide.

19. The traveler of claim 14, in which the coupler of the middle ring of the securing structure comprises a metal tubular piece having an inside through which the external beam passes.

20. The traveler of claim 14, in which the end ring and the middle ring are connected by:

a longitudinal beam in the upper part of each of the end ring and the middle ring, joining the two L-shaped beams on an internal side of the arch;

two flat beams affixed to the coupler of each of the end ring and the middle ring;

two main load-bearing girders, placed in a parallel manner, that join the lower beams in the lower part of each of the end ring and the middle ring; and a transversal cross-brace and two horizontal cross-braces on the side of each of the end ring and the middle ring corresponding to the external side of the arch.

21. The traveler of claim 14, in which the external beam and the upper beam are connected by the coupler inside each of the end ring and the middle ring, and the two external beams are connected by the coupler between the end ring and the middle ring.

22. The traveler of claim 7, in which each of, the forward tracks comprises an interior step, and in which the forward hydraulic cylinders are coupled on a first end to the lower part of the upper beam, and the forward hydraulic cylinders are coupled at a second to the step of each of the forward tracks.

23. The traveler of claim 14, in which the upper beam comprises at least one rolling leg affixed to its lower part, for guiding movement of the traveler as the at least one rolling leg moves along the forward tracks.

24. The traveler of claim 14, further comprising:

a plurality of crossbeams in an area located on the securing structure, between the forward tracks; and a wedge-shaped platform in an area located on the working structure, under the forward tracks;

such that the relative position of the forward tracks is fixed by the plurality of crossbeams and the wedge-shaped platform.

25. The traveler of claim 14, in which the securing structure further comprises:

a plurality of threaded bars affixed on a first end to holes on an upper part of the already-built section of the engineering work, and affixed on a second end to a plurality of wedge-shaped pieces affixed to a lower part of the forward tracks.

26. The traveler of claim 24, in which the working structure further comprises:

an interior formwork providing an interior shape of a section of the engineering work being constructed;

a plurality of panels located on a side corresponding to the external side of the arch, the plurality of panels being held by a plurality of shoring props supported by a plurality of horizontal guides;

the floor formwork being supported on the plurality of horizontal guides;

each of the plurality of horizontal guides being supported on a main load-bearing girder;

the wedge-shaped platform being affixed to the forward tracks;

a plurality of vertical beams located on the side of each of the end ring and the middle ring corresponding to the internal side of the arch, an upper part of the vertical beams being coupled to the wedge-shaped platform and a lower part of the vertical beams being coupled to the horizontal guides.

27. The traveler of claim 26, in which the interior formwork is affixed to the wedge-shaped platform located under the forward tracks in the area of the working structure by means of threaded bars.

28. The traveler of claim 26, in which at least one dimension of a section of the engineering work being constructed can be modified by at least one of the following actions:

removal of at least one of the plurality of panels located on the external side of the arch;

displacement of the shoring props through the horizontal guides;

removal of at least one of the plurality of panels located on the internal side of the arch; and removal of the plurality of vertical beams on the internal side of the arch.

29. The traveler of claim 1, in which the end ring, the middle ring, the transversal cross-brace and the plurality of connecting elements between the end ring and the middle ring of the securing structure are formed as a single piece.

* * * * *